US006174072B1

(12) United States Patent
Root, Jr.

(10) Patent No.: US 6,174,072 B1
(45) Date of Patent: Jan. 16, 2001

(54) ILLUMINATED ORNAMENTAL APPARATUS

(76) Inventor: Donald D. Root, Jr., 6423 Zang Ct., Arvada, CO (US) 80004

( * ) Notice: Under 35 U.S.C. 154(b), the term of this patent shall be extended for 0 days.

(21) Appl. No.: 09/466,331

(22) Filed: Dec. 17, 1999

(51) Int. Cl.[7] ..... F21S 9/00

(52) U.S. Cl. ..... 362/190; 362/800; 362/806; 362/200; 362/253

(58) Field of Search ..... 362/157, 190, 362/189, 800, 806, 278, 253, 122, 230, 231, 191, 200, 201, 254; 313/501; 40/444, 564, 571, 574

(56) References Cited

U.S. PATENT DOCUMENTS

| | | | | |
|---|---|---|---|---|
| 333,727 | | 1/1886 | Campbell . | |
| 816,996 | | 4/1906 | Plass . | |
| 2,134,356 | | 10/1938 | Clemence . | |
| 2,561,217 | | 7/1951 | Muir . | |
| 2,798,148 | * | 7/1957 | Di Lizio et al. | 362/102 |
| 3,727,043 | | 4/1973 | Wall . | |
| 3,732,414 | * | 5/1973 | Franc | 362/806 |
| 3,737,647 | | 6/1973 | Gomi . | |
| 4,055,840 | | 10/1977 | Uchytil et al. . | |
| 4,283,797 | * | 8/1981 | Seider | 362/108 |
| 4,398,237 | | 8/1983 | Doyel | 362/186 |
| 4,652,980 | | 3/1987 | Segan | 362/86 |
| 4,886,687 | | 12/1989 | Malott | 428/4 |
| 4,895,741 | * | 1/1990 | Coffman | 428/5 |
| 4,910,647 | | 3/1990 | Gong | 362/122 |
| 5,075,830 | | 12/1991 | Perez | 362/352 |
| 5,079,046 | | 1/1992 | Kessler | 428/4 |
| 5,117,344 | | 5/1992 | Perez | 362/352 |
| 5,228,686 | | 7/1993 | Maleyko | 273/58 G |
| 5,315,492 | | 5/1994 | Davenport | 362/122 |
| 5,508,901 | | 4/1996 | Kuo | 362/122 |
| 5,526,243 | | 6/1996 | Masters | 362/122 |
| 5,558,422 | * | 9/1996 | Sanford | 362/806 |
| 5,567,037 | | 10/1996 | Ferber | 362/104 |
| 5,609,411 | | 3/1997 | Wang | 362/234 |
| 5,918,964 | | 7/1999 | Bou | 362/186 |
| 5,921,674 | | 7/1999 | Koczi | 362/800 |
| 6,012,820 | * | 1/2000 | Weber et al. | 362/806 |
| 6,017,132 | * | 1/2000 | Miller et al. | 362/806 |
| 6,020,823 | * | 2/2000 | DeCicco | 340/691.2 |

* cited by examiner

*Primary Examiner*—Thomas M. Sember
(74) *Attorney, Agent, or Firm*—Gibson, Dunn & Crutcher LLP; Stanley J. Gradisar

(57) ABSTRACT

An illuminated ornamental apparatus for decorating gift packages or other objects consisting of a bow that has an LED integrated within it. The LED is powered by a small battery encased in a housing, forming an LED assembly. A switch to turn the LED on and off is located on the outside of the housing in a manner to allow the LED to be switched on just prior to presentation of the gift package. The best results are achieved when the bow is made using either translucent (semi-opaque) or reflective (metallic) polypropylene ribbon materials of various colors, sizes, or configurations to create a multitude of unique and distinctive bows. The LED assembly may be integrated into the bow in several different ways. In one embodiment the housing is located below the bow. A small hole in the bottom of the bow allows the LED to extend up into the mid internal area of the bow, where the light from the LED can reflect or pass through the various loops of bow material as well as through spaces between the loops of bow material. Affixed to the bottom of the housing is a means to attach the illuminated bow to the gift package or other object.

16 Claims, 5 Drawing Sheets

ILLUMINATED ORNAMENTAL APPARATUS

FIELD OF THE INVENTION

This invention relates to decorating gift packages and, more particularly, to an illuminated ornamental apparatus for decorating gift packages.

BACKGROUND OF THE INVENTION

When giving gifts, it is traditional to decorate the gift package with wrapping paper, ribbons, and bows of various sizes, colors, and shapes. The wrapping paper itself, as well as the ribbons and bows, are designed to be attractive and to catch the eye of the recipient. Thus, bows come in a wide variety of sizes, colors, and shapes and are made out of a wide variety of materials to be used for these purposes. Bows may also be attached to other objects besides gift packages to achieve ornamental affect, such as to doors, walls, automobiles, etc.

SUMMARY OF THE INVENTION

There is a need in the art to improve upon decorating gift packages and other objects with bows in order to bring more attention to the gift package or object. There is also a need in the art to make bows that are more unique, attractive, and pleasing to the eye. Thus, it is an aspect of the present invention to decorate a gift package or object with a bow that can be illuminated. Another aspect of the invention is to illuminate the bow with a light emitting diode (LED) placed inside the bow. Still another aspect of the invention is to use ribbon for the bow material that is highly transmissive or reflective of light. A still further aspect of the invention is to be able to attach and reattach the illuminated bow from one package or object to another in an easy manner. Another aspect of the invention is to allow the LED within the bow to blink or flash. Another aspect of the invention is to utilize a bi-color LED in the illuminated bow.

The above and other aspects of the invention are accomplished in a bow that has an LED assembly integrated within it. LEDs come in many different colors which are well suited for this use. For example, red and green LEDs are appropriate for bows at Christmas, as well as other colors. The LED is powered by a small battery encased in a base or housing, forming an LED assembly. The LED assembly is integrated within the bow's structure forming the illuminated ornamental apparatus of the present invention.

The best results are achieved when the bow is made using either translucent (semi-opaque) or reflective (metallic) polypropylene ribbon materials of various colors, sizes, or configurations to create a multitude of unique and distinctive bows. Excellent eye-catching results are obtained with bows utilizing translucent or reflective material. One such reflective material is a silver propylene ribbon material that affords a prismatic effect by being surfaced with countless shiny dots of mirror-like coating.

The LED assembly may be integrated into the bow in several different ways. In one embodiment the housing is located below the base of the bow. A small hole in the bottom of the base of the bow allows the LED to extend up into the mid internal area of the bow, where the light from the LED can reflect or pass through the various loops of bow material as well as through spaces between the loops of bow material.

Affixed to the bottom of the housing is a means to attach the illuminated bow to the gift package. Various attachment methods may be used. For example, a well known self-adhesive crack-and-peel type backing may be affixed to the bottom of the housing. Once the waxy protective paper is peeled away, the sticky surface of the crack-and-peel backing is exposed. When the sticky surface is pressed against the wrapping paper of the gift package, or a gift box with no wrapping paper, the illuminated bow becomes attached.

Another attachment method utilizes Velcro® brand fastening tape, which consists of two mated strips. Each strip has a sticky back protected by a waxy paper cover. One strip has miniature nylon hooks on the non-sticky back side, and the other mated strip has an uncut pile material on the non-sticky back side. After removing the waxy paper cover, the sticky back of one strip is attached to the bottom of the housing, and the sticky back of the other strip is attached to the gift package. The exposed hook and uncut pile material are then matched and pressed together, affixing the bow to the gift package. This approach is advantageous because it allows for easy transfer and reuse of the bow from gift package to gift package by utilizing additional Velcro® brand fastening tape having exposed hook and uncut pile material.

In another embodiment, the housing is located entirely within the bow. The bottom of the housing is securely affixed to the upper surface of the bottom of the bow. A crack-and-peel type of backing attached to the bottom of the bow allows for attaching the illuminated bow to the gift package or gift box. Velcro® brand fastening tape having exposed hood and uncut pile material could also be used.

A switch to turn the LED on and off is located on the outside of the housing in a manner to allow the LED to be switched on just prior to presentation of the gift package. The illuminated bow can be switched off and then on again anytime thereafter. One skilled in the art will recognize that a switch is not necessary, but is useful. For example, in an embodiment of the invention without a switch, the battery could be installed just prior to affixing the illuminated bow to a gift package and presenting the gift package to the recipient.

LEDs are small in size, light in weight, operate under low power and low voltage, are highly luminous at a small current, and produce only negligibly small amounts of heat, and thus are quite safe when incorporated within a bow. In addition, many ribbons and other materials used in making bows are made out of flame retardant material, increasing the safety. LEDs can provide illumination for several hours using only a small battery for power.

Bows equipped with such an LED assembly integrated within the bow may be utilized in other ways besides on gift packages. They may also be used for general decoration and ornamentation purposes for parties and events, and affixed to walls, doors, tables, chairs, and other objects. They may also be used in sales and marketing displays in order to attract more attention to the products on display.

DETAILED DESCRIPTION

Figure 2:
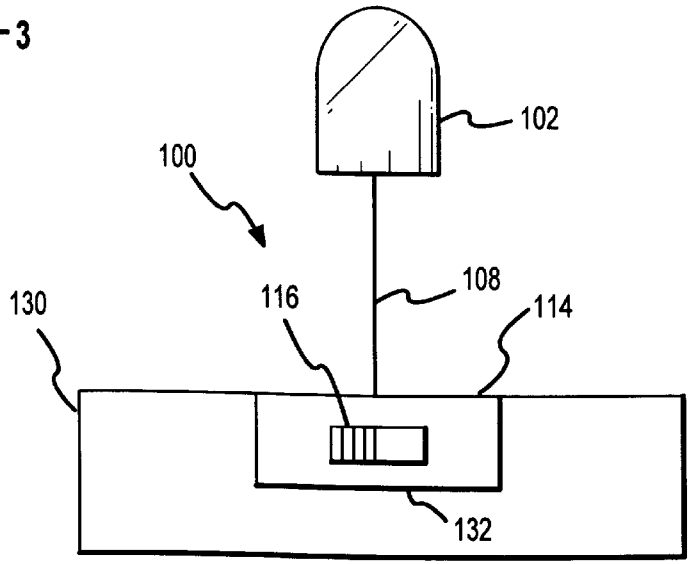
FIG. 2 shows front plane view of the LED assembly of FIG. 1.
Figure 1:
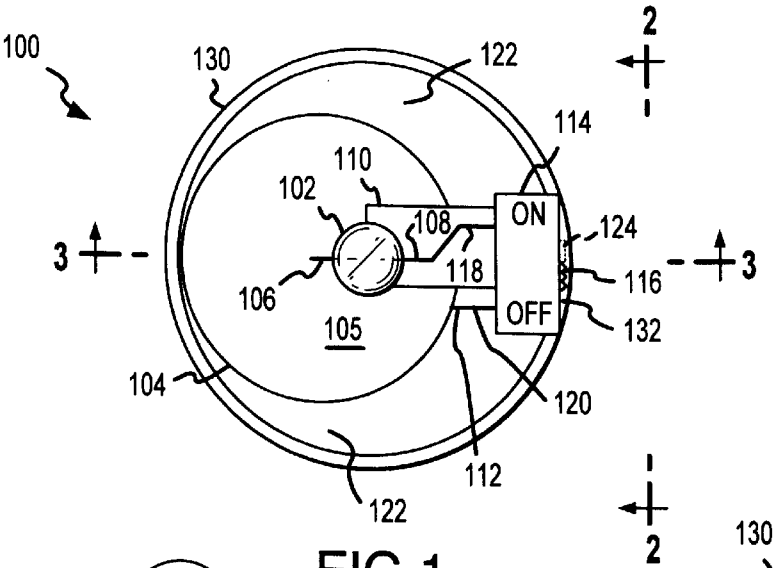
FIG. 1 shows a top plane view of an embodiment of an LED assembly that utilizes a single-color LED with steady illumination.
Figure 3:
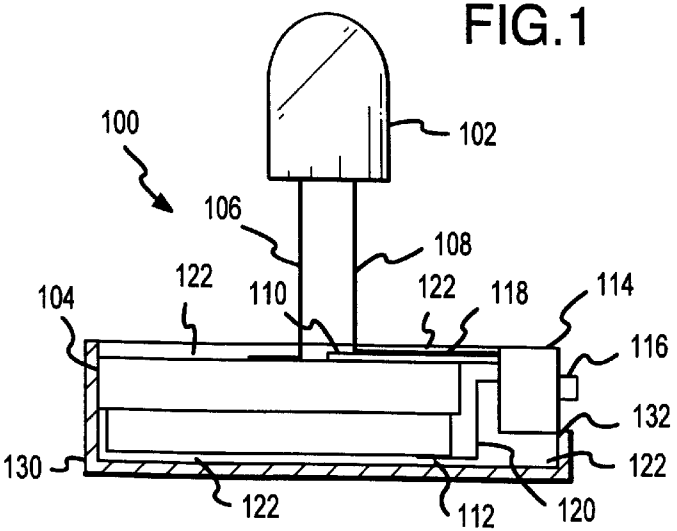
FIG. 3 shows a partial cutaway side view of the LED assembly of FIG. 1.

FIGS. 1, 2, and 3 show an embodiment of an LED assembly that utilizes a single-color LED with steady illumination. In FIG. 2, base 130 is shown partially cutaway. Referring now to FIGS. 1, 2 and 3, LED assembly 100 has a base 130 which serves to house battery 104 and dip switch 114. LED 102 is powered by battery 104 in a circuit. One skilled in the art will recognize that there are many different combinations of LEDs and batteries that could be employed to work cooperatively together. Good results have been obtained utilizing LEDs in the 1 to 3 volt range, along with a 3 volt coin type lithium battery. A lithium battery with or without connector leads may be utilized.

LED 102 has anode lead 106 and cathode lead 108. Anode lead 106 is electrically connected to the positive connector lead, or to the positive surface side 105 of battery 104 if there is no connector lead. Typically, in either case, the electrical connection is accomplished through soldering. Cathode lead 108 is electrically connected to on side pin 118 of dip switch 114. This connection is also usually made by soldering.

Dip switch 114 is a one-position dip switch. One skilled in the art will recognize that other types of switches could also be used. Cathode lead 108 and on side pin 118 are prevented from contacting the positive surface side 105 of battery 104 by insulating strip 110, which is secured to the positive surface side 105 of battery 104. Dip switch 114 has a switch 116. Switch 116 is shown in an "off" position, and phantom switch position 124 shows the location of switch 116 in the "on" position. Off side pin 120 of dip switch 114 is connected to negative battery lead 112, or to the negative surface side of battery 104 if there is no connector lead. Again, this connection is usually made by soldering.

Battery 104 and dip switch 114 are secured within base 130 by using epoxy 122, which fills the voids within base 130 because of the free flowing consistency of the epoxy, and then hardens. Battery 104 and dip switch 114 are positioned within base 130 such that dip switch 114 fits into notch 132 on one side of base 130. Enough epoxy is used to completely encase battery 104 and dip switch 114, with only LED 102, a portion of anode lead 106, and a portion of cathode lead 108 extending in a mostly perpendicular direction above base 130 after the epoxy hardens. One skilled in the art will recognize that other methods of securing battery 104 and dip switch 114 may also be used, but epoxy is preferred because it results in a water resistant and shock resistant assembly.

When switch 116 is in the "off" position, the circuit is open and LED 102 is not illuminated. When switch 116 is in the "on" position, the circuit is closed and LED 102 is illuminated. LED assembly 100 is integrated within a bow to form the illuminated ornamental apparatus of the present invention, more fully described below in FIGS. 10 and 11.

Figure 5:
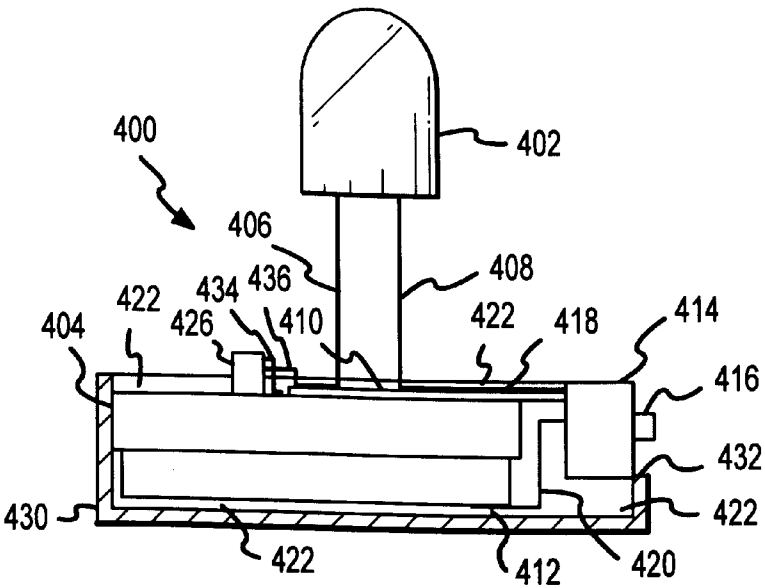
FIG. 5 shows a partial cutaway side view of the LED assembly of FIG. 4.
Figure 4:
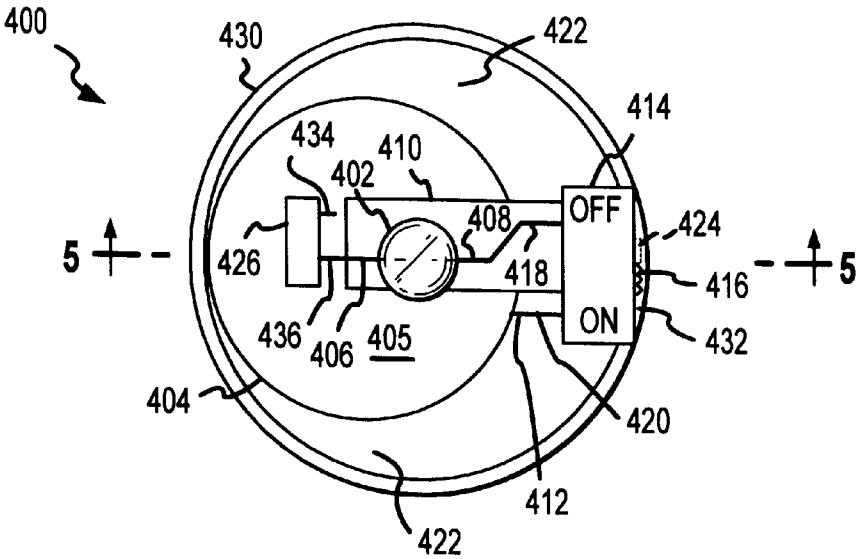
FIG. 4 shows a top plane view of another embodiment of an LED assembly that utilizes a single-color LED that flashes or blinks.

FIGS. 4 and 5 show another embodiment of an LED assembly that utilizes a single-color LED that flashes or blinks. In FIG. 5, base 430 is shown partially cutaway. Referring now to FIGS. 4 and 5, LED assembly 400 has LED 402, battery 404, positive surface side 405, anode lead 406, cathode lead 408, insulating strip 410, negative battery lead 412, dip switch 414, switch 416, epoxy 422, phantom switch position 424, base 430, and notch 432 which are described as the similarly referenced characters in FIGS. 1–3. Anode lead 406 is electrically connected to a flasher cathode lead 436 of a flash circuit 426, which is well known in the art. A flasher anode lead 434 of flash circuit 426 is connected to positive surface side 405 of battery 404 through a soldered connection. Negative battery lead 412 is connected to an on side pin 420 of dip switch 414. Cathode lead 408 is connected to an off side pin 418 of dip switch 414. Anode lead 406, flasher cathode lead 436, cathode lead 408, and off side pin 418 are prevented from contacting positive surface side 405 of battery 404 through insulating strip 410. When switch 416 is in the "on" position (as shown in FIG. 4), the circuit is complete and flash circuit 426 switches LED 402 between an illuminated state and a non-illuminated state causing LED 402 to flash or blink. In an alternative embodiment, flash circuit 426 may be built into and contained within LED 402.

Figure 7:
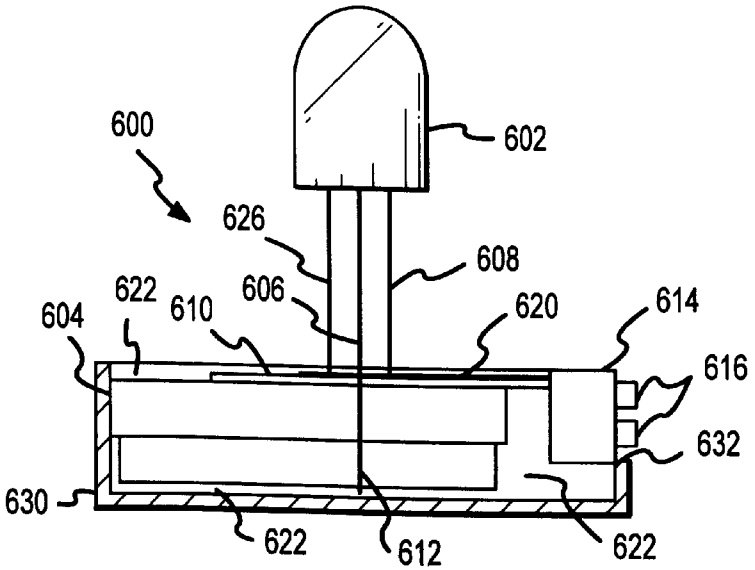
FIG. 7 shows a partial cutaway side view of the LED assembly of FIG. 6.
Figure 6:
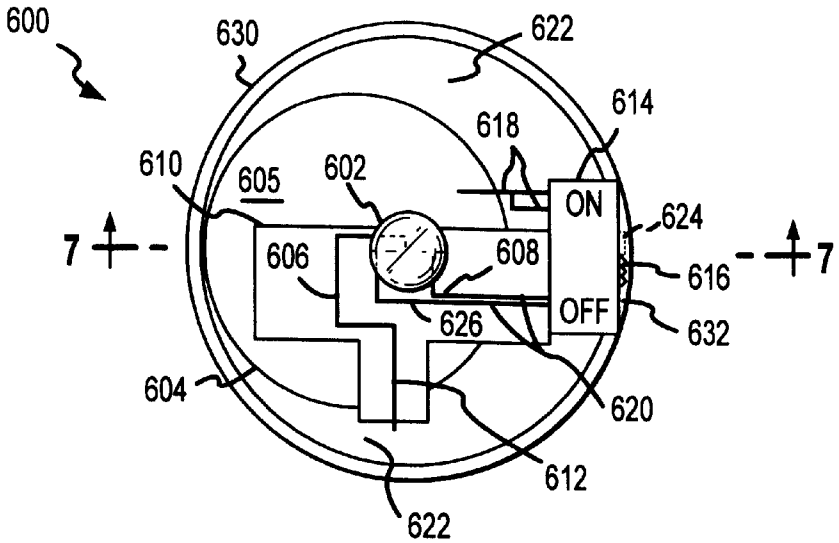
FIG. 6 shows a top plane view of another embodiment of an LED assembly that uses a bi-color LED with steady illumination.

FIGS. 6 and 7 show another embodiment of an LED assembly that utilizes a bi-color LED with steady illumination. In FIG. 7, base 630 is shown partially cutaway. Referring now to FIGS. 6 and 7, LED assembly 600 has battery 604, positive surface side 605, insulating strip 610, negative battery lead 612, epoxy 622, base 630, and notch 632 which are described as the similarly referenced characters in FIGS. 1–3. Bi-color LED 602 has a common lead 606, a first color lead 608, and a second color lead 626. Dip switch 614 is a two position dip switch and has two switches 616 and two phantom switch positions 624. Common lead 606 is electrically connected to negative battery lead 612. First color lead 608 is electrically connected to one of the off side pins 620, and second color lead 626 is connected to the other of the off side pins 620. Common lead 606, first color lead 608, negative battery lead 612, off side pins 620, and second color lead 626 are prevented from coming into contact with positive surface side 605 of battery 604 through insulating strip 610. Both on side pins 618 are joined together and then connected to positive surface side 605 of battery 604. When one of the switches 616 is in the "on" position, one of the colors of bi-color LED 602 will illuminate, and when the second switch 616 is in the "on" position, the second color of bi-color LED will illuminate.

Figure 9:
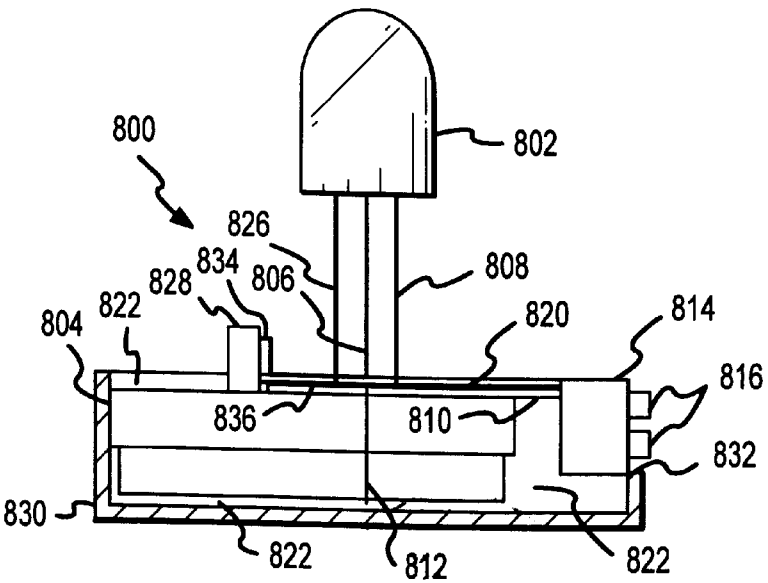
FIG. 9 shows a partial cutaway side view of the LED assembly of FIG. 8.
Figure 8:
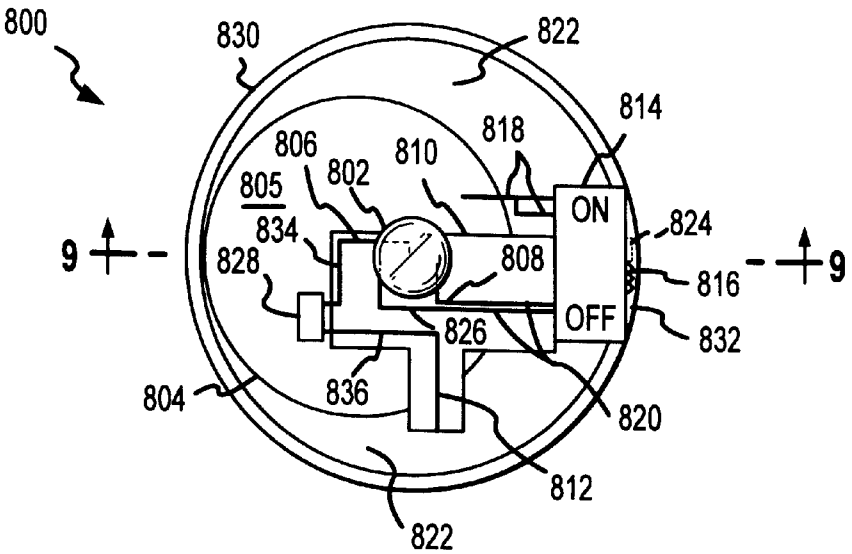
FIG. 8 shows a top plane view of another embodiment of an LED assembly that utilizes a bi-color LED that flashes or blinks.

FIGS. 8 and 9 show another embodiment of an LED assembly that utilizes a bi-color LED that flashes or blinks. In FIG. 9, base 830 is shown partially cutaway. Referring now to FIGS. 8 and 9, LED assembly 800 has bi-color LED 802, battery 804, positive surface side 805, common lead 806, first color lead 808, insulating strip 810, negative battery lead 812, dip switch 814, switches 816, on side pins 818, off side pins 820, epoxy 822, phantom switch positions 824, base 830, and notch 832 which are described as the similarly referenced characters in FIGS. 6 and 7. Common lead 806 is electrically connected to a flasher anode lead 834 of flash circuit 828. Negative battery lead 812 is connected to a flasher cathode lead 836 of flash circuit 828. Common lead 806, first color lead 808, negative battery lead 812, off side pins 820, and second color lead 826 are prevented from coming into contact with positive surface side 805 of battery 804 through insulating strip 810. When one of the switches 816 is in the "on" position, then the LED color in that circuit will flash or blink. When the second switch 816 is in the "on" position, then the second color within LED 802 will flash or blink. In another embodiment of the invention, flash circuit 828 may be incorporated directly within bi-color LED 802.

Figure 10:
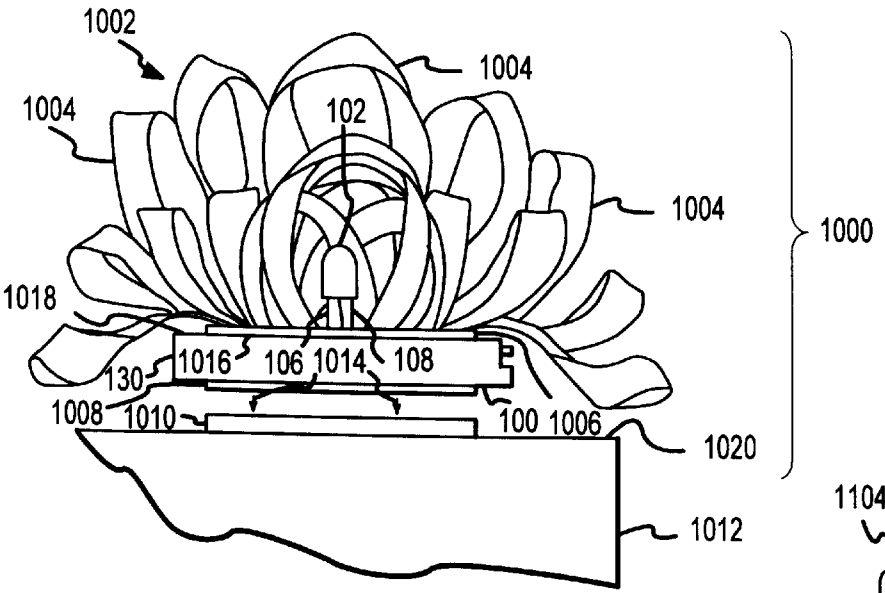
FIG. 10 shows one embodiment of the illuminated ornamental apparatus of the present invention illustrating one method of integrating the LED assembly within a bow and affixing the illuminated ornamental apparatus to a gift package.

FIG. 10 shows one embodiment of the illuminated ornamental apparatus of the present invention illustrating one method of integrating the LED assemblies 100, 400, 600, or 800 within a bow and affixing the illuminated ornamental apparatus to a gift package. For the purposes of this figure, illuminated ornamental apparatus 1000 has LED assembly 100 integrated within bow 1002, which is shown with the front half of bow loops 1004 cut away to reveal LED assembly 100. Referring now to FIG. 10, bow 1002 has multiple bow loops 1004 which are secured together to a base 1006 in a manner that is well known in the art. Base 1006 may be plastic or stiff cardboard or other suitable material. Bow loops 1004 may be made from a variety of materials of varying widths, resulting in bows of various shapes and sizes. Base 1006 has a hole cut through its approximate center and the hole extends through any bow material gathered at that hole location to allow LED 102 and portions of anode lead 106 and cathode lead 108 to pass through the hole and extend into an internal portion of bow loops 1004 of bow 1002. A bottom side 1016 of base 1006 is secured to a top surface 1018 of base 130 through gluing or any other appropriate attaching method. For example, base 1006 may be a self-adhesive crack-and-peel type backing. Once the waxy protective paper is peeled away, the sticky surface of the crack-and-peel backing is exposed. When the sticky surface of bottom side 1016 is pressed against top surface 1018 of base 130, bow 1002 becomes attached to base 130.

Strips 1008 and 1010 are two mated strips of Velcro® brand fastening tape having exposed hood and uncut pile material. Strip 1008, which may be the hook strip or the uncut pile strip, is secured to the bottom side of base 130 with its sticky back. Strip 1010 is the mate of strip 1008. The sticky back of strip 1008 is secured to a surface 1020 of gift package 1012. When strip 1008 is pressed into contact with its mate strip 1010 in the direction indicated by arrows 1014, then illuminated ornamental apparatus 1000 is secured to gift package 1012. Illuminated ornamental apparatus 1000 may also be easily removed from gift package 1012 by pulling strips 1008 and 1010 apart, and may be easily attached to another gift package by utilizing another mated strip of the Velcro® brand fastening tape having exposed hook and uncut pile material.

Figure 11:
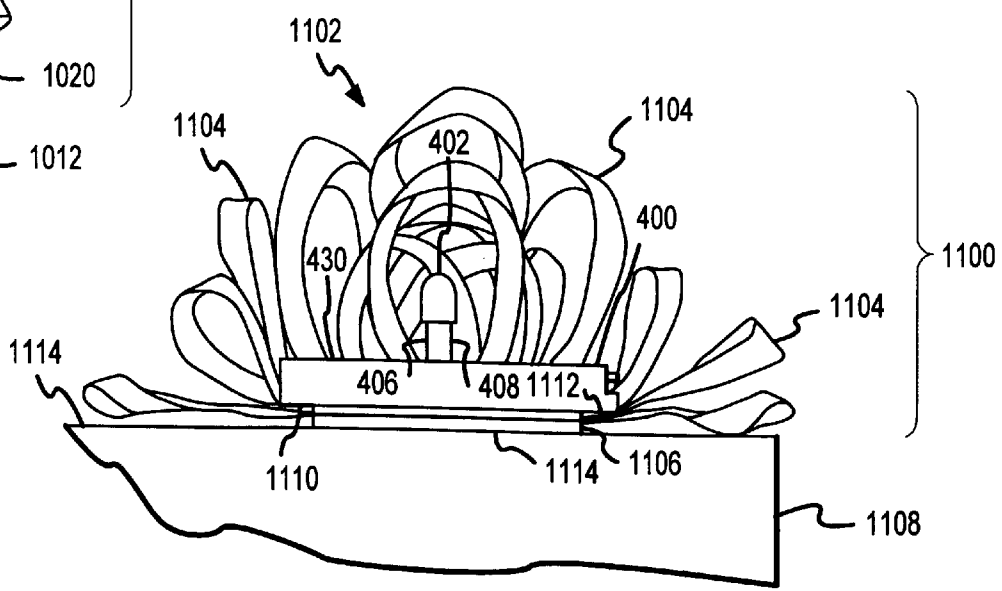
FIG. 11 shows another embodiment of the illuminated ornamental apparatus of the present invention illustrating another method of integrating the LED assembly within a bow and affixing the illuminated ornamental apparatus to a gift package.

FIG. 11 shows another embodiment of the illuminated ornamental apparatus of the present invention illustrating another method of integrating the LED assemblies 100, 400, 600, or 800 within a bow and affixing the illuminated ornamental apparatus to a gift package. For the purposes of this figure, illuminated ornamental apparatus 1100 has LED assembly 400 integrated within bow 1102, which is shown with the front half of bow loops 1104 cut away to reveal LED assembly 400. Referring now to FIG. 11, bow 1102 has multiple bow loops 1104 which are secured together to a base 1106 in a manner that is well known in the art. Base 1106 may be plastic or stiff cardboard or other suitable material. Bow loops 1104 may be made from a variety of materials of varying widths, resulting in bows of various shapes and sizes. A bottom side 1110 of base 430 is then secured to an upper surface 1112 of the bow material that lies directly above base 1106. Base 430 may be attached to the bow material through gluing or any other appropriate attaching method. Base 1106 may be a crack-and-peel type backing. Once the waxy protective paper is peeled away, the sticky surface of the crack-and-peel backing is exposed. When the sticky surface a bottom side 1114 of base 1106 is pressed against a top surface 1114 of gift package 1108, then illuminated ornamental apparatus 1100 becomes affixed to the gift package. One skilled in the art will recognize that base 1106 could be replaced with Velcro® brand fastening tape having exposed hook and uncut pile material as shown in FIG. 10, and in FIG. 10 strips 1008 and 1010 could be replaced with a crack-and-peel type backing as shown in this FIG. 11.

Having described a presently preferred embodiment of the present invention, it will be understood by those skilled in the art that many changes in construction and circuitry and widely differing embodiments and applications of the invention will suggest themselves without departing from the scope of the present invention, as defined in the claims. The disclosures and the description herein are intended to be illustrative and are not in any sense limiting of the invention, defined in scope by the following claims.

What is claimed is:

1. An illuminated ornamental apparatus for attaching to an object comprising:

a bow having a plurality of bow loops secured to a top side of a bow base, wherein said bow base defines a hole therein that extends from a bottom side of said bow base through said top side of said bow base and through said plurality of bow loops secured to said bow base at said hole;

an LED having a front end and a back end, wherein an anode lead and a cathode lead extend from said back end of said LED, and further wherein said front end of said LED extends through said hole in said bow base to an inner portion of said plurality of bow loops;

a battery located on said bottom side of said bow base, said battery electrically connected to said anode lead and said cathode lead forming a circuit, wherein said LED illuminates said plurality of bow loops of said bow;

a base containing said battery, said base having a bottom side and a top side, said top side of said base fixedly attached to said bottom side of said bow base; and a means for attaching the illuminated ornamental apparatus to the object, wherein said means for attaching is secured to said bottom side of said base.

2. An illuminated ornamental apparatus for attaching to an object according to claim 1 further comprising:

a flasher circuit within said circuit, wherein when said battery provides power to said LED, said flasher circuit switches said LED between an illuminated state and a non-illuminated state so as to cause said LED to blink.

3. An illuminated ornamental apparatus for attaching to an object according to claim 1 wherein said plurality of bow loops are made from a translucent ribbon material.

4. An illuminated ornamental apparatus for attaching to an object according to claim 1 wherein said plurality of bow loops are made from a reflective ribbon material.

5. An illuminated ornamental apparatus for attaching to an object according to claim 1 further comprising:

a switch within said circuit wherein said switch closes and opens said circuit.

6. An illuminated ornamental apparatus for attaching to an object according to claim 1 wherein said LED is a bi-color LED having a front end and a back end, wherein a common lead, a first color lead, and a second color lead extend from said back end of said LED and are electrically connected to said circuit.

7. An illuminated ornamental apparatus for attaching to an object according to claim 6 further comprising:

a two position dip switch within said circuit having a first switch movable to an on position and movable to an off position, and a second switch movable to an on position and movable to an off position, wherein when said first switch is moved to said on position, a first color of said bi-color LED is illuminated, and further wherein when said second switch is moved to said on position, a second color of said bi-color LED is illuminated.

8. An illuminated ornamental apparatus for attaching to an object according to claim 6 further comprising:

a flasher circuit within said circuit, wherein when said battery provides power to said bi-color LED, said flasher circuit switches said bi-color LED between an illuminated state and a non-illuminated state so as to cause a first color and a second color of said bi-color LED to blink.

9. An illuminated ornamental apparatus for attaching to an object comprising:

a bow having a plurality of bow loops secured to a top side of a bow base;

an LED having a front end and a back end, wherein an anode lead and a cathode lead extend from said back end of said LED;

a battery electrically connected to said anode lead and said cathode lead forming a circuit;

a base containing said battery, said base having a bottom side and a top side, wherein said bottom side of said base is fixedly attached to said top side of said bow base, and said LED extends from said top side of said base to an inner portion of said plurality of bow loops of said bow illuminating said plurality of bow loops of said bow; and a means for attaching the illuminated ornamental apparatus to the object, wherein said means for attaching is secured to said bottom side of said bow base.

10. An illuminated ornamental apparatus for attaching to an object according to claim 9 further comprising:

a flasher circuit within said circuit, wherein when said battery provides power to said LED, said flasher circuit switches said LED between an illuminated state and a non-illuminated state so as to cause said LED to blink.

11. An illuminated ornamental apparatus for attaching to an object according to claim 9 wherein said plurality of bow loops are made from a translucent ribbon material.

12. An illuminated ornamental apparatus for attaching to an object according to claim 9 wherein said plurality of bow loops are made from a reflective ribbon material.

13. An illuminated ornamental apparatus for attaching to an object according to claim 9 further comprising:

a switch within said circuit wherein said switch closes and opens said circuit.

14. An illuminated ornamental apparatus for attaching to an object according to claim 9 wherein said LED is a bi-color LED having a front end and a back end, wherein a common lead, a first color lead, and a second color lead extend from said back end of said LED and are electrically connected to said circuit.

15. An illuminated ornamental apparatus for attaching to an object according to claim 14 further comprising:

a two position dip switch within said circuit having a first switch movable to an on position and movable to an off position, and a second switch movable to an on position and movable to an off position, wherein when said first switch is moved to said on position, a first color of said bi-color LED is illuminated, and further wherein when said second switch is moved to said on position, a second color of said bi-color LED is illuminated.

16. An illuminated ornamental apparatus for attaching to an object according to claim 14 further comprising:

a flasher circuit within said circuit, wherein when said battery provides power to said bi-color LED, said flasher circuit switches said bi-color LED between an illuminated state and a non-illuminated state so as to cause a first color and a second color of said bi-color LED to blink.

* * * * *